US007614981B2

(12) United States Patent
Cao

(10) Patent No.: US 7,614,981 B2
(45) Date of Patent: Nov. 10, 2009

(54) WEIGHT SELECTION SYSTEM FOR FITNESS TRAINING EQUIPMENT

(76) Inventor: Guofang Cao, 2641 Shady Ridge La., Diamond Bar, CA (US) 91765

( * ) Notice: Subject to any disclaimer, the term of this patent is extended or adjusted under 35 U.S.C. 154(b) by 29 days.

(21) Appl. No.: 11/760,966

(22) Filed: Jun. 11, 2007

(65) Prior Publication Data

US 2008/0305936 A1 Dec. 11, 2008

(51) Int. Cl.
*A63B 21/062* (2006.01)

(52) U.S. Cl. ..... 482/98; 482/99

(58) Field of Classification Search ..... 482/92–94, 482/98–103, 106–108
See application file for complete search history.

(56) References Cited

U.S. PATENT DOCUMENTS 1,053,109 A * 2/1913 Reach ..... 482/99
4,610,449 A * 9/1986 Diercks, Jr. ..... 482/98
5,374,229 A * 12/1994 Sencil ..... 482/98
5,484,367 A * 1/1996 Martinez ..... 482/107
5,785,632 A * 7/1998 Greenberg et al. ..... 482/5
6,174,265 B1 * 1/2001 Alessandri ..... 482/5
2004/0005968 A1 * 1/2004 Crawford et al. ..... 482/106
2007/0004569 A1 * 1/2007 Cao ..... 482/94

* cited by examiner

*Primary Examiner*—Loan H Thanh
*Assistant Examiner*—Oren Ginsberg
(74) *Attorney, Agent, or Firm*—Jen-Feng Lee

(57) ABSTRACT

A weight stack selection system for fitness equipment. A central stem having offset lateral movement is eliminated by the present invention. The select pin is easier for insertion to the selected desired weight due to the lack of accumulated thickness that plagued the industry. A moving block is used to intuitively select the desired weight, when said moving block is moved up and down on a rail. A safety pin is built in to each plate, so that said moving block cannot be moved unless the weight plates are in the released and settled state. A dial on a belt assembly, which drives the up/down movement of said moving block, furthers the intuitive selection means of dialing into the desired weight for training purpose.

5 Claims, 9 Drawing Sheets

WEIGHT SELECTION SYSTEM FOR FITNESS TRAINING EQUIPMENT

RELATED APPLICATION

The present invention relates to a prior application by the same inventor. Said prior application was filed on Jun. 30, 2005, having application Ser. No. 11/160,621.

FIELD AND BACKGROUND OF THE INVENTION

The present invention relates generally to an improved design and construction of fitness training equipment wherein users can select the desired amount of weight from a stack of weight plates.

Selectable amount of weight is commonly found on various fitness training equipments. A popular method is by using a central stem going down the center holes of a stack of weight plates, wherein an insertion pin can be inserted through a hole on the side of each weight plate and through the central stem, forming the point of pick-up when users are engaging in exercising, as shown in FIG. 0. All the weight plates above the point of insertion pin will be the desired total weight. When users pull the cable, all the plates below the point of insertion pin will NOT be selected.

This type of popular weight selection system has at least three problems plaguing the industry:

a. The hole on the side of each weight plate has to match (be aligned) with the correspondent hole on the stem. Due to the accumulated thickness error of the weight plates, however, the top one or two holes on the weight plates oftentimes do not match up with the top one or two holes on the central stem. This poses a problem for users when insertion of the insertion pin is taking place at the top portion of the weight stack, unless the weight plates are machined to a very tight tolerance, which requires costlier production to achieve such precision.

b. When the central stem is lifted up, the bottom of the central stem will oftentimes have a lateral offset from the top of the remaining unselected weight stack, interrupting the smooth and successful of restoration of the central stem (insertion back down) into the weight stack, as the bottom tip of the stem will sometimes get suck on the surface of a weight stack, instead of going through the center hole of the weight plates.

c. Insertion pin gets lost easily. Even though insertion pins are tied to a cable, as many gyms customarily do it this way, some cables are cut to take away the insertion pins.

The present invention uses an up-down sliding block as the selection means, plus an additional belt-driven dial, to build on a link-connector system as disclosed in prior application, to solve the above-stated problems.

OBJECTS AND SUMMARY OF THE INVENTION

The present invention provides a link-connector mechanism, instead of a central stem, to work as the weight selection system and completely avoid the issue of accumulated thickness errors that plagued the industry.

Moreover, present invention contains a selection dial that allows the intuitive use of "dialing into" the correct weight as desired by users, resulting in simply and safe use of weight training equipment.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 0:
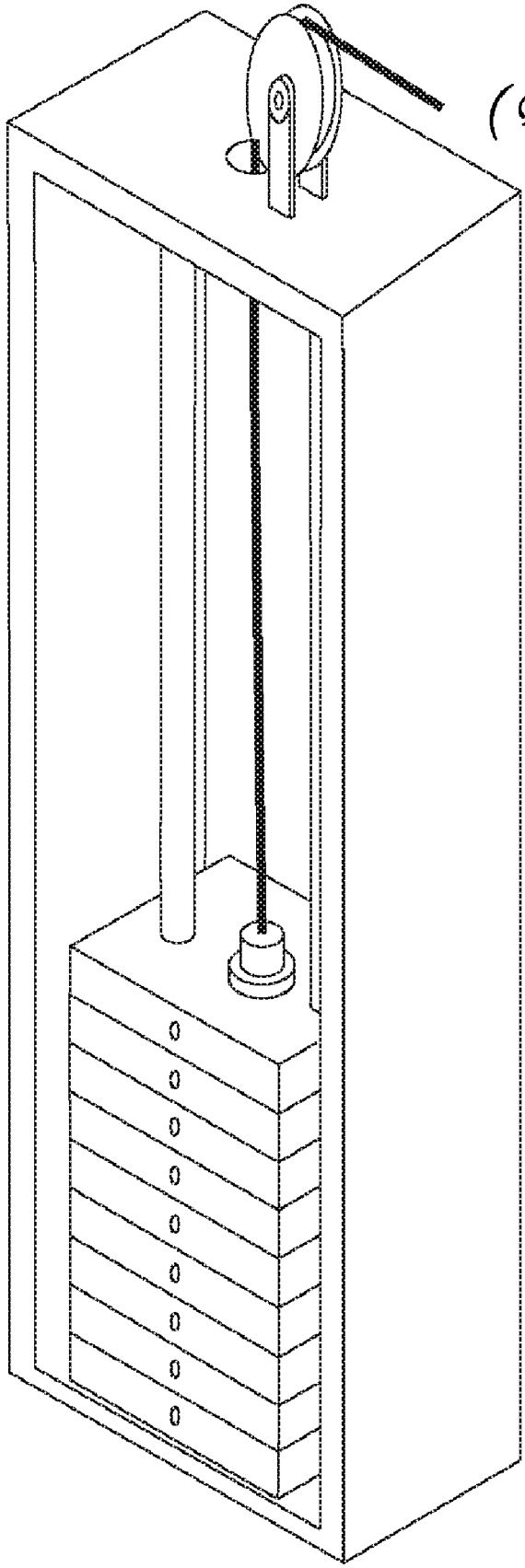
Figure 0 ( Prior Art )
FIG. 0 shows the status of prior art, as described previously and as seen on the market.
Figure 1:
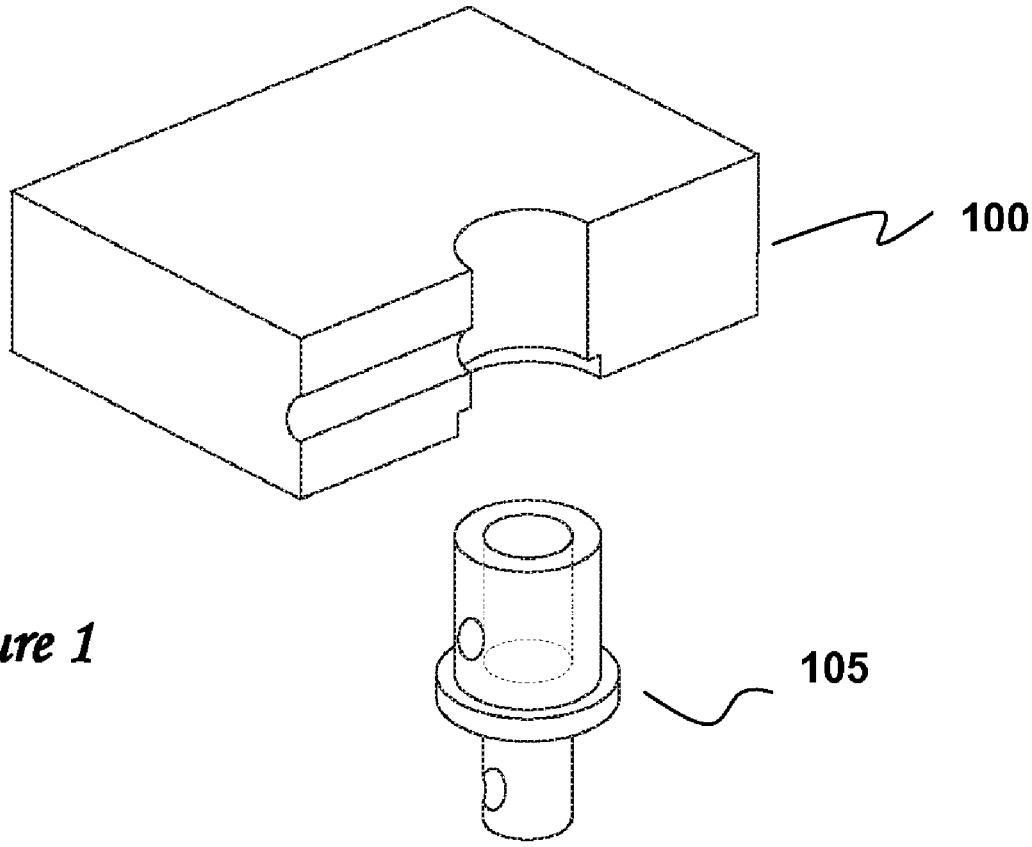
FIG. 1 shows a link-connector and a half-cut view of a weight plate.
Figure 2:
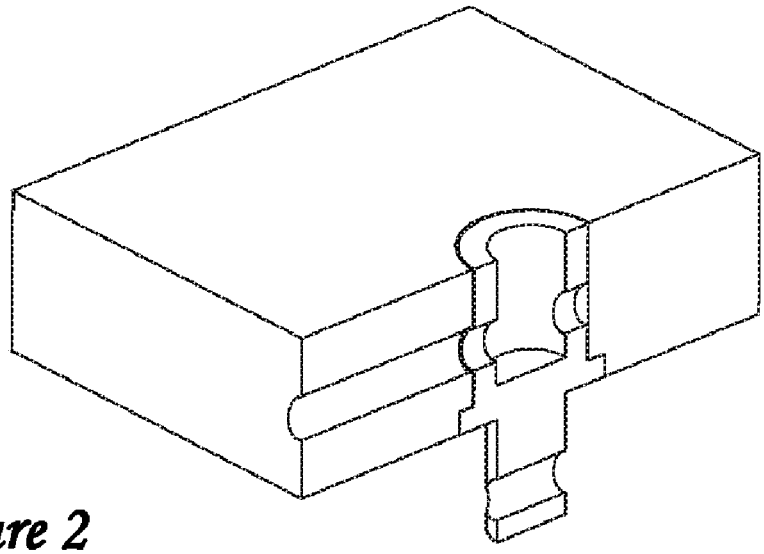
FIG. 2 shows the half-cut view of a weight plate, having the link-connector inserted, forming a weight plate selected unit.

In FIGS. 1 and 2, the basic construction of present invention is shown, having one weight plate 100 matching one link-connector 105, constituting a weight unit, when selected.

Figure 3:
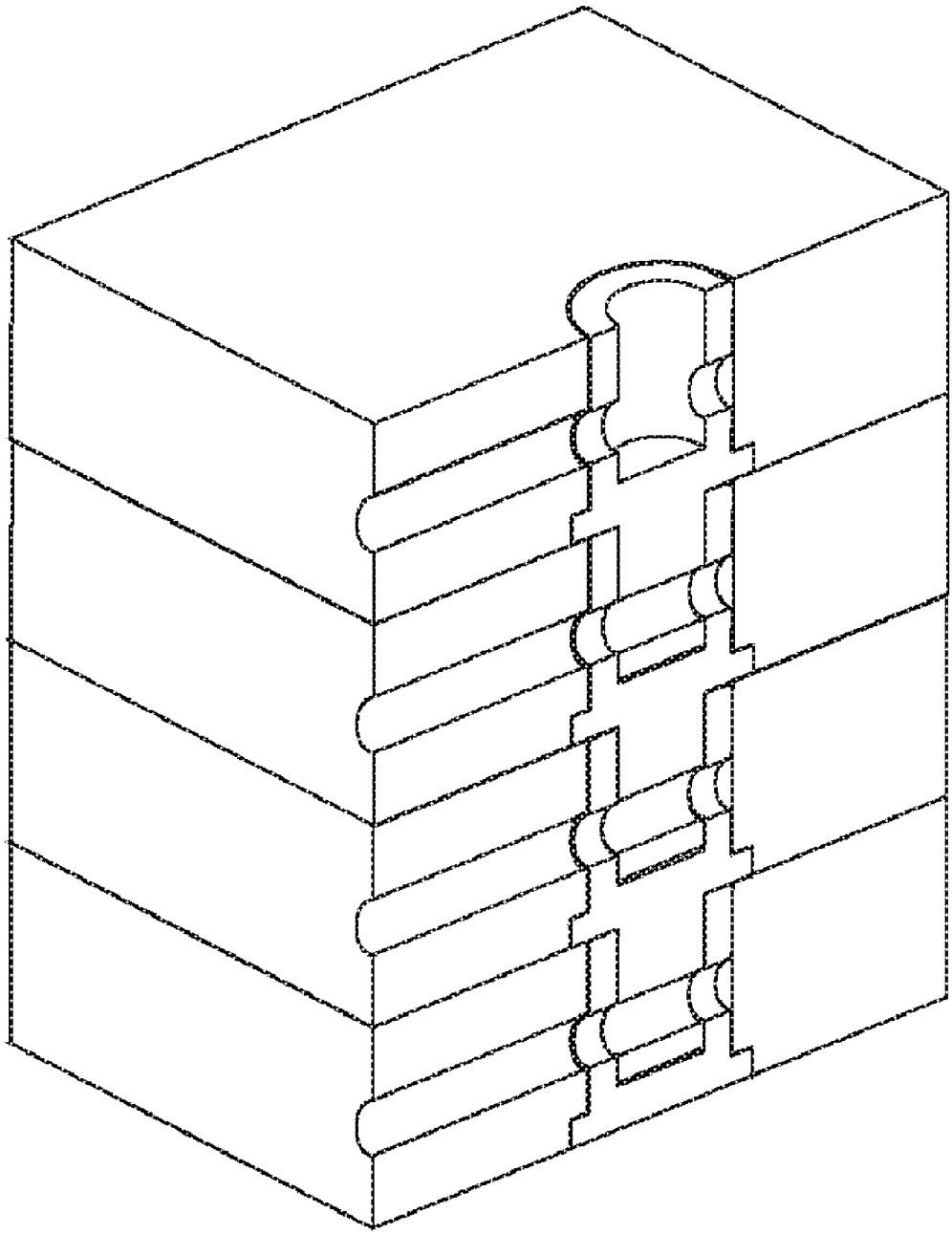
FIG. 3 shows a plurality of weight plates (4 of them, in this figure) being stacked together.

FIG. 3 shows a stack of weight plates (four of them). There is a slot for the select pin 110 to insert through each weight plate 100 to be engaged to one link-connector 105.

Figure 4:
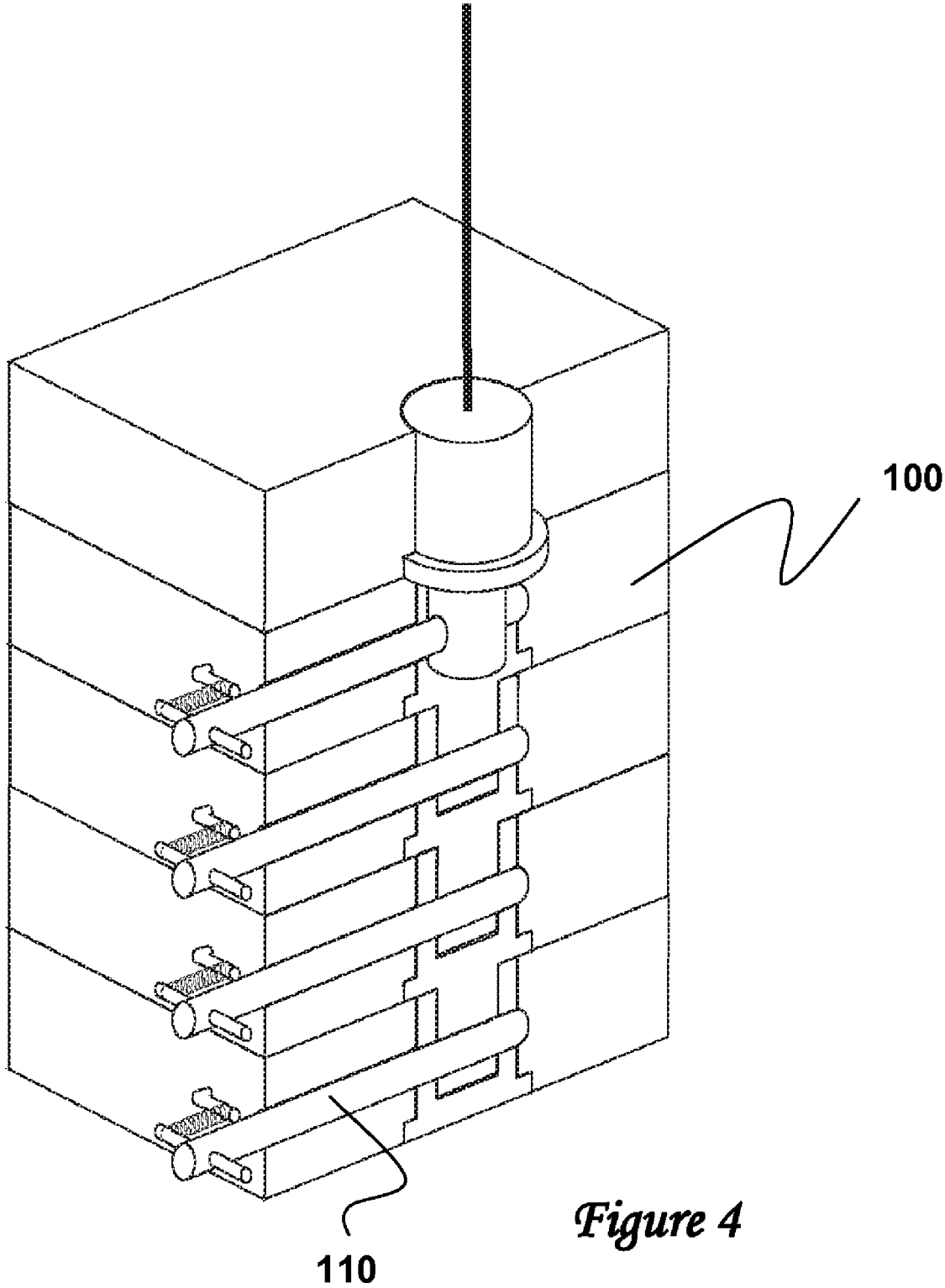
FIG. 4 shows each link-connector on each weight plate has a select pin, which is attached to a pulling spring.

FIG. 4 shows four weight plates 100 being selected, with four select pins 110 being engaged through the corresponding link-connector 105 when the pulling spring 115 is at its natural compressed state.

Figure 5:
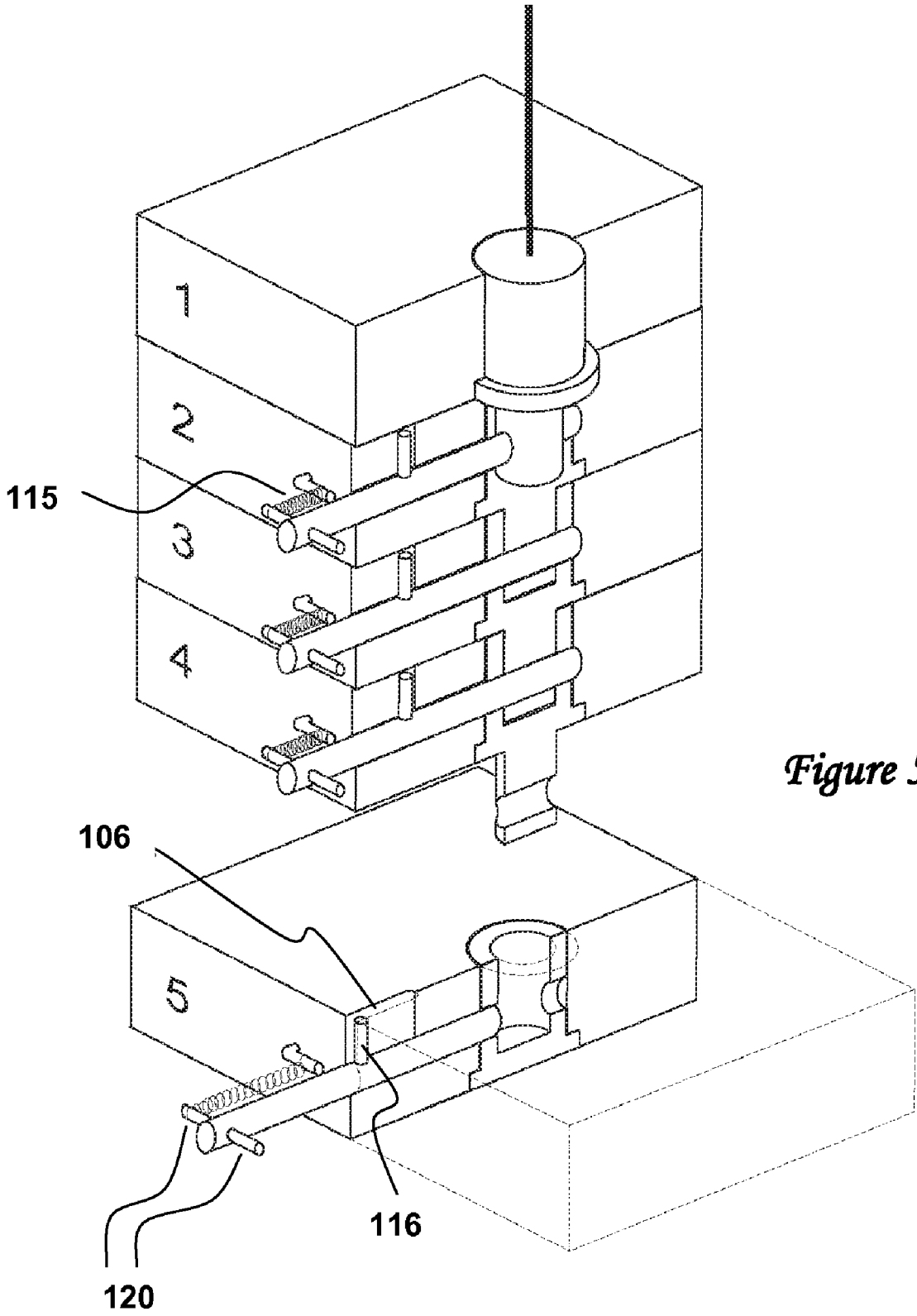
FIG. 5 shows four weight plates are selected, by disengaging select pin number 5.

FIG. 5 shows when a particular select pin 110 is pulled out, that weight plate 100 is de-selected. The weight plates 100 above that particular pulled out select pin 110 are the desired weight. Pulling spring 115 must be pulled to extend from its natural compressed state, to disengage said select pin 110.

Within each weight plate, a guide-slot 106 is formed, so that a G-pin 116, attached to select pin 110, can maintain the rotational stability of select pin 110.

Figure 6:
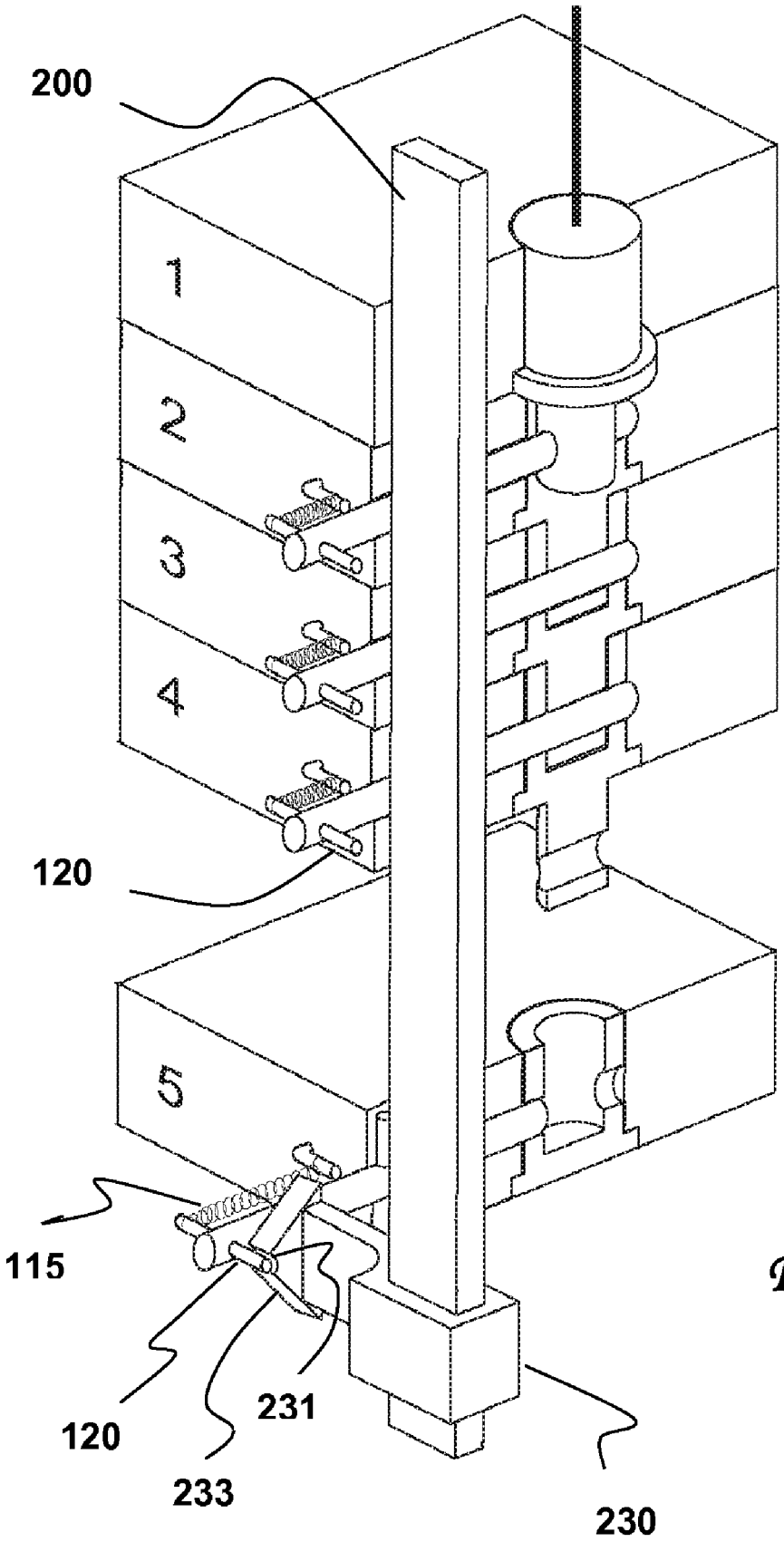
FIG. 6 shows a moving block can travel up and down the rail, depending on user selection of desired weight.

FIG. 6 shows a vertical rail 200 on the front side of weight plates 100. A moving block 230 can travel up and down the distance of said vertical rail 200. On the end of each select pin 110, there is a T-pin 120 so oriented to park on a park-slot 231 on a triangular tip 233 of said moving block.

It can be seen that said triangular tip 233 of moving block 230 can slide through each T-pin 120 of each select pin 110, so that the pulling spring 115 gets extended, and the T-pin 120 is then "parked" on the park-slot 231, resulting in that select pin 110 to be disengaged from a link-connector 105, as shown in FIG. 6, having the weight plates 110 above the parked point to be the selected desired weight.

Figure 7:
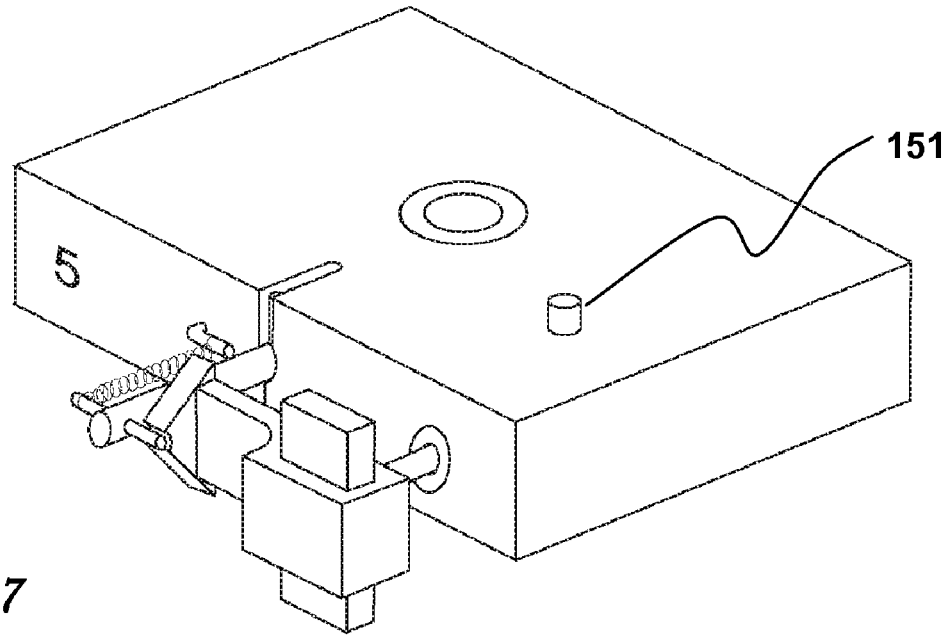
FIG. 7 shows one weight plate, being part of a vertical rail/block selection system.
Figure 8:
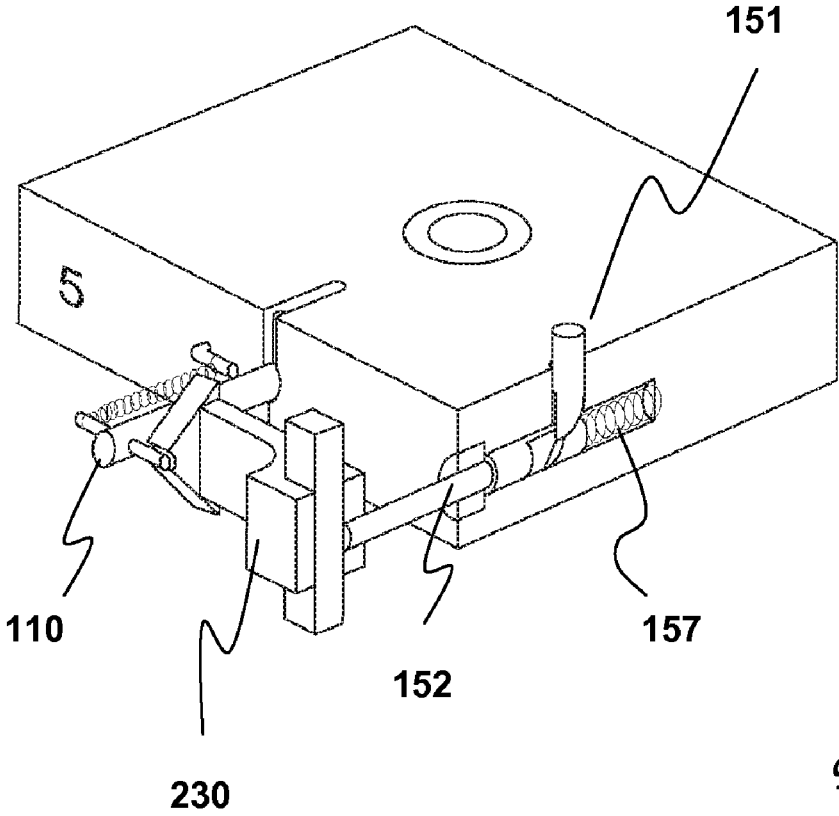
FIG. 8 shows the safety mechanism built to each weight plate.

FIGS. 7 and 8 show the construction of a wedge pin 151 and a corresponding safety pin 152. Safety pin 152 slidably resides in a hole parallel to that for the select pin 110, as a safety mechanism for present invention.

Wedge pin 151 and safety pin 152 form a bevel-gear type contact with each other, as shown in FIG. 8, so that a pushout spring 157 will cause said safety pin 152 to slide outwards and insert into a slot at the back of said moving block 230, locking the vertical position of moving block 230, due to the pushout spring's 157 natural extension power.

Except for the topmost weight plate, all the wedge pins 151 will get push downward, which then cause safety pin 152 to slide inwards, compressing said pushout spring 157, and "unlocking" moving block 230.

Figure 9:
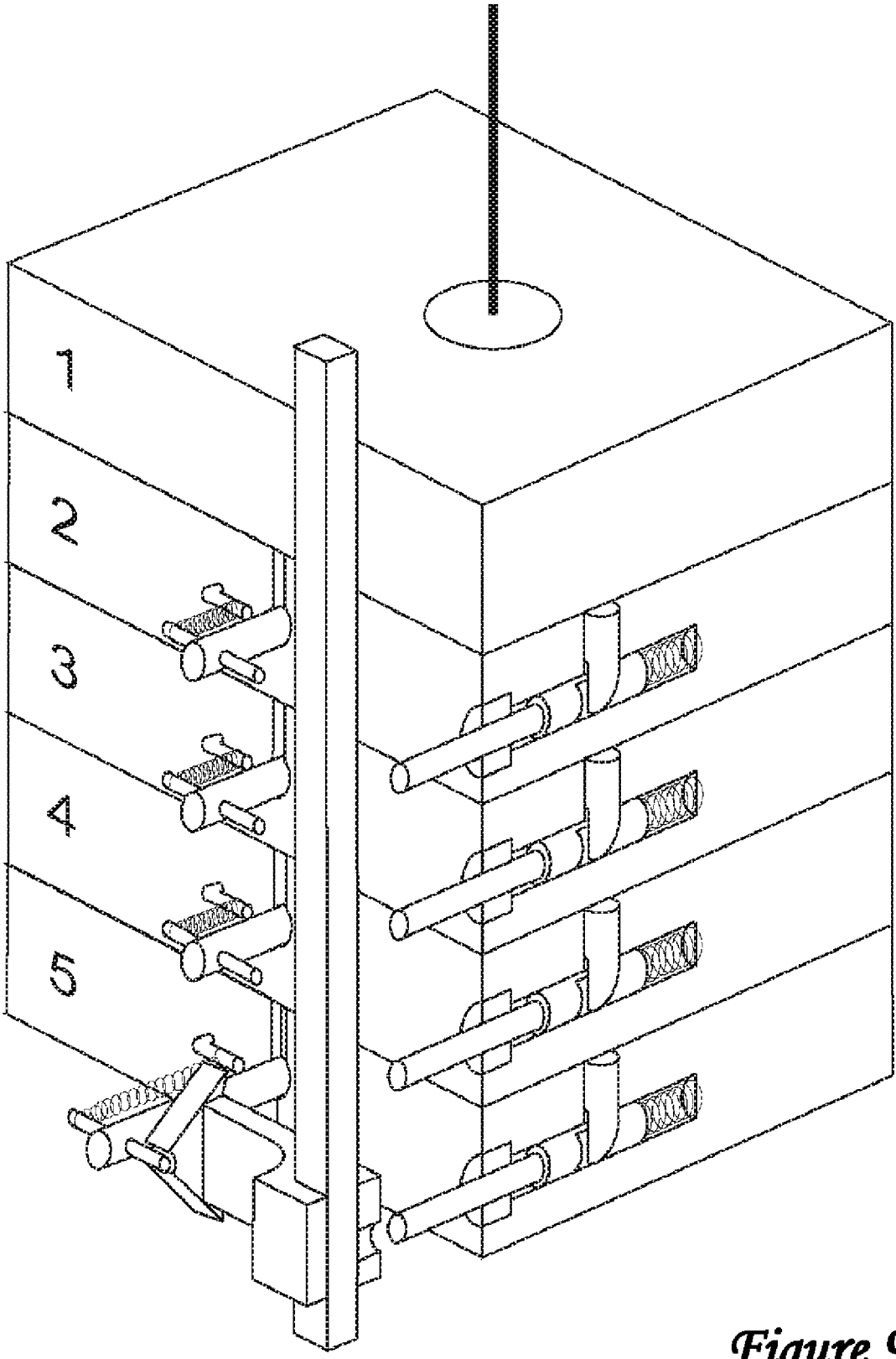
FIG. 9 shows the selection of a stack of weight plates.

FIG. 9 shows the safety feature of such wedge pin 151 and safety pin 152. When desired weight is being lifted up, one particular safety pin 152 will be pushed outward to engage, and therefore "lock" moving block 230 in place, due to the fact that there is no downward gravity force to keep wedge pin 151 down, allowing pushout spring 157 to push safety pin 152 outward and wedge pin 151 upward.

When the selected weight plates settled down on top of the engaged plate (when no force is being exerted on the weigh training equipment), the wedge pin 151 is pressed down, causing the safety pin 152 to disengage from the hole of the moving block 230, resulting in the moving block 230 to be free for moving up or down, for purpose of selecting weight.

Figure 10:
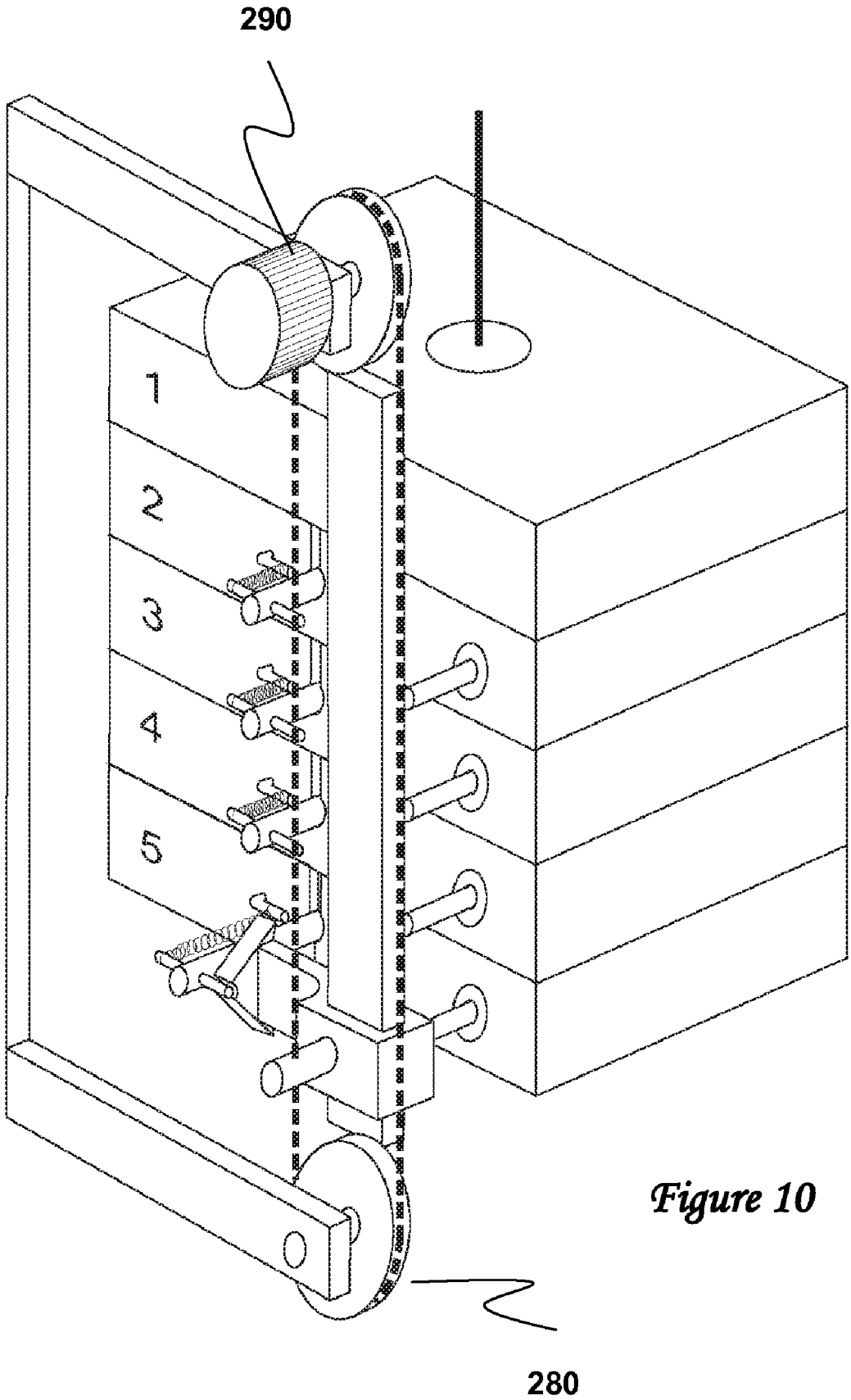
FIG. 10 shows a belting assembly being connected to the moving block, creating a simple "dial" wheel on top, allowing intuitive user selection by simply "dialing into" the desired weight.

FIG. 10 shows a belting assembly 280 added to move the moving block 230. A dialing wheel 290 is affixed to the top wheel of belting assembly 280, so that turning the dialing wheel 290 will cause the moving block 230 to travel up and down the rail 200. A visual cue or indicator can be further added to vicinity of the dialing wheel 290, so that users can intuitively "dial in" to the desired weight, when the moving block 230 is set to the desired corresponding number of weight plates as the selected weight, at the weight plates' "settled down" state.

What is claimed is:

1. Weight selection system for fitness equipment, comprising:

a. A plurality of separably engageable link-connectors that can be connected vertically;

b. A plurality of weight plates each having a vertical center hole for engageably receiving one link-connector;

c. A select pin that can be slidably fitted through a hole on the side of each weight plate to each link-connector, said select pin further having a pulling spring to cause the select pin engage one link-connector when the pulling spring is in its natural compressed state; and, d. A vertical rail along side said plurality of weight plates, said rail contains a moving block with a triangular tip to push out the select pin at the selected plate in order to disengage the select pin from the link-connector.

2. Weight selection system for fitness equipment of claim 1, further comprising:

e. A vertical G-pin on each select pin; and, h. A guide-slot is formed on one side of each weight plate, so that said G-pin travels along said guide-slot, preventing the select pin from rotating.

3. Weight selection system for fitness equipment of claim 2, further comprising:

g. A T-pin on each select pin; and, h. A park-slot is formed on the triangular tip of said moving block, so that the T-pin of select pin is parked on the triangular tip when being selected at the pulled out state.

4. Weight selection system for fitness equipment of claim 3, further comprising:

i. A set including a wedge pin and safety pin on each weight plate, wherein said wedge pin is placed vertically through a hole to slidably engage said safety pin which is horizontally placed inside a hole of the weight plate, whereby the wedge pin in a pushed down state will compress a position spring inside of said safety pin, disengaging said safety pin from said moving block.

5. Weight selection system for fitness equipment of claim 4, further comprising:

j. A vertical belting assembly connected to said moving block;

k. A dialing wheel at a top end of said belting assembly, whereby said dialing wheel turns to control the up/down travel and position of said moving block, forming an intuitive user selection system for fitness equipment.

* * * * *